166-308 SR
5/19/87 XR 4,665,980

United States Patent [19]
Bodine

[11] Patent Number: 4,665,980
[45] Date of Patent: May 19, 1987

[54] METHOD FOR IMPROVING WELL PRODUCTION BY SONICALLY DRIVING GRANULAR MEDIUM INSTALLED IN WELL

[76] Inventor: Albert G. Bodine, 7877 Woodley Ave., Van Nuys, Calif. 91406

[21] Appl. No.: 842,983

[22] Filed: Mar. 24, 1986

[51] Int. Cl.[4] ..... E21B 43/04; E21B 43/10
[52] U.S. Cl. ..... 166/249; 166/51; 166/71; 166/278; 166/308
[58] Field of Search ..... 166/51, 71, 177, 74, 166/104, 157, 249, 278, 308; 175/19, 56, 55

[56] References Cited

U.S. PATENT DOCUMENTS

| | | | |
|---|---|---|---|
| 3,375,884 | 4/1968 | Bodine, Jr. | 175/55 |
| 3,379,263 | 4/1968 | Bodine, Jr. | 175/19 |
| 3,624,760 | 11/1971 | Bodine | 175/56 |
| 4,257,482 | 3/1981 | Kompanek | 166/177 |
| 4,393,932 | 7/1983 | Bodine | 166/249 |
| 4,544,031 | 10/1985 | Bodine | 166/308 |
| 4,548,281 | 10/1985 | Bodine | 166/249 |

*Primary Examiner*—Stephen J. Novosad
*Assistant Examiner*—Bruce M. Kisliuk
*Attorney, Agent, or Firm*—Edward A. Sokolski

[57] ABSTRACT

A granular medium such as gravel is emplaced in the bottom of a well. A well liner is attached to the end of a drill pipe and lowered to the bed of gravel. The drill pipe is then driven at a sonic frequency which may be a resonant frequency of vibration of the vibrating system including the pipe and the liner. A packing seal is provided between the outer wall of the drill pipe and the inner wall of the well casing to prevent the gravel from rising up the casing. The liner is sonically driven so that it penetrates into the gravel medium, the gravel being trapped beneath the seal. The gravel is fluidized by the sonic energy and packed uniformly around the liner to provide a filter for the well effluent. Further, the fluidized granular medium may be highly pressurized by the sonic energy plus the system weight so that it operates to fracture the surrounding formation to engender greater flow from the well.

8 Claims, 3 Drawing Figures

METHOD FOR IMPROVING WELL PRODUCTION BY SONICALLY DRIVING GRANULAR MEDIUM INSTALLED IN WELL

This invention relates to the use of sonic energy to enhance the production of a well and more particularly to a method in which an oil well liner is sonically driven into a granular medium to fluidize and pressurize this medium such that it may act both as a filter and engenders fracturing of the surrounding formation.

In the installation of oil and water wells, a perforated liner is placed in the bottom of the well casing to permit the passage of the desired liquid material but to prevent the flow into the casing of foreign material such as sand, tar material and other undesirable foreign substances. As an additional aid in preventing such foreign matter from entering the casing or liner or clogging up the perforations thereof, an annular layer of tightly packed fine gravel is installed around the apertured portions of the casing, the gravel being fine enough to effectively filter out the foreign material, but not so fine as to itself pass through the perforations in the casing. In my U.S. Pat. No. 4,393,932, a method and apparatus is described in which sonic energy is employed to fluidized the gravel material so that it uniformly distributes itself and packs down with an absence of voids therein. In practicing this method the liner is first installed in place and then the gravel is flowed therearound and finally the sonic energy applied to the liner to effect the fluidization of the gravel.

In an effort to increase the yield of oil wells drilled into sedimentary formations hydraulic fracturing (HYDRO-FRAC) is often employed. In carrying out this process the well is intermittently subjected to high hydraulic pressure by forcing high pressure liquid therein to effect a fracturing of the surrounding earthern formation to open up flow paths for the well liquid. The use of a liquid such as water in implementing such fracturing has the disadvantage of contaminating the formation. This is particularly undesirable in the case of gas wells. In my U.S. Pat. No. 4,544,031 an apparatus for fracturing an earthen formation surrounding a well to engender an increased flow from the well is described. In the system of this prior patent, a wedging tool is sonically driven against the walls of the well to effect the desired fracturing without the use of a liquid for achieving the desired end results.

The method of my present invention in one preferred form affords an improved technique for achieving the objectives of both my aforementioned '932 and '031 patents, namely, by both providing a filtering medium surrounding the well liner and by providing means for fracturing the formation to improve the fluid flow into the well.

The improved end results are achieved in the present invention by first emplacing a granular medium such as gravel in the bottom of a well, a perforated well liner is then attached to the end of a drill pipe and lowered into the well until it rests on top of the gravel bed formed at the bottom of such well. A sonic energy source which may be in the form of an orbiting mass oscillator is then employed to generate sonic energy which is coupled to the drill string and the well liner. A packing seal is provided between the drill pipe and the inner wall of the casing to effectively prevent the gravel from rising up beyond the top of a well liner. The sonic energy is preferably applied to the drill pipe and liner at a frequency which causes resonant elastic vibration of these elements thereby providing high level sonic vibratory force to the gravel bed. The sonic energy fluidizes the gravel being so forced up around the liner so that it is uniformly distributed around the liner with tight compaction to provide articularly effective filtering action. At the same time if desired the gravel may be sonically driven with additional high force against the surrounding formation at the bottom of the well to cause fracturing thereof which enhances the production of the well.

It is therefore an object of this invention to improve the filtering of foreign substances from the output of a well.

It is a further object of this invention to improve the yield of a well by fracturing the surrounding formation without the use of a liquid medium.

Other objects of this invention will become apparent as the description proceeds in connection with the accompanying drawings of which:

Figure 1:
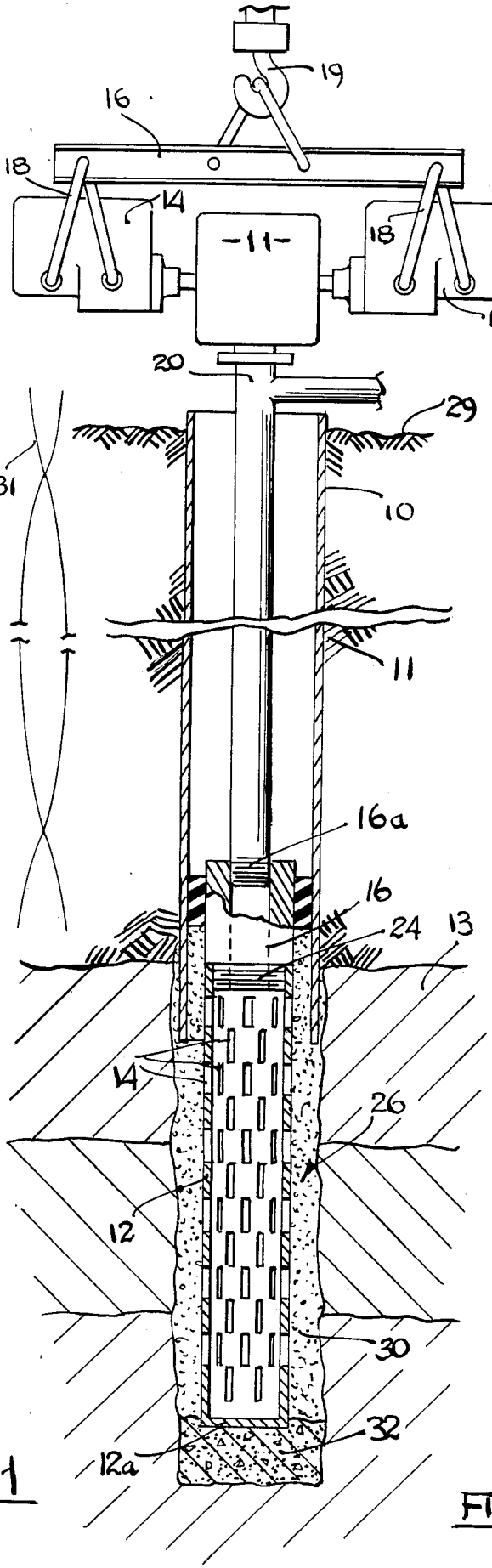
FIG. 1 is an elevational view in cross section illustrating the method of the invention.

Referring now to FIG. 1, the method of the invention is carried out as follows:

Casing 10 is first installed through the overburden earthen material 11 to a fluid producing formation 13 which may yield oil or water as the case may be. Packer tool 16 is threadably joined at the surface to liner 12 which has multiple perforations 14 formed therein. Packer tool 16 has an annular packer gland 20 forming a fluid tight annulus therearound. A drill pipe 20 is threadably attached to the top end of packer tool 16 at the surface and the pipe string is then lowered into the well. A sonic oscillator 11 which comprises an orbiting mass oscillator formed by paired eccentric rotors which are driven by engines 14 as described in my U.S. Pat. Nos. 3,189,106 and 3,684,037 is attached to the top end of drill pipe 20. The oscillator-engine assembly is suspended from support beam 16 by means of suspension struts 18, beam 16 in turn being suspended from the hook 19 of a derrick (not shown). This oscillator assembly and suspension structure is the same as that described in my U.S. Pat. No. 4,544,031.

Drill pipe 20 and along with it well liner 12 which is attached thereto is lowered into the well with packer gland 20 forming a seal against the inner wall of well casing 10. The liner 12 which has a cover **12*a* on the bottom end thereof is lowered until cover 12*a* rests on the top of the gravel bed 30. The liner is permitted to rest by virtue of the weight of drill pipe 20 and the oscillator assembly on the top of the gravel bed while oscillator 11 is energized by virtue of the drive of engines 14. The speed of rotation of the engines is adjusted to effect longitudinal elastic resonant vibration of drill pipe 20 and liner 12 as indicated by standing wave graph lines 31. The standing wave vibration causes the liner to sonically fluidize the gravel and to penetrate into the gravel bed displacing the gravel up along the sides of the liner as indicated in FIG. 1. The gravel is prevented from rising above the top of the liner by elastomeric packing gland 20. The gravel bed 26 is fluidized and uniformly distributed and compacted sonically around the liner to provide a highly effective filter for the well fluid. At the same time, if desired sustained high level sonic energy is imparted to the gravel to effect fracturing of the formation 13** to enhance fluid flow into the well liner.

Figure 1A:
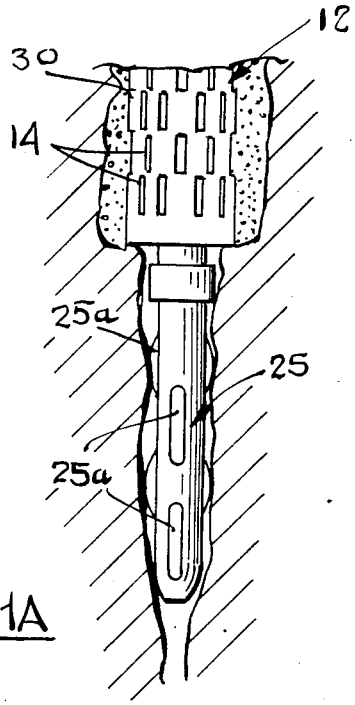
FIG. 1A is a cross sectional view illustrating an optional additional step that may be employed in carrying out the method of the invention.

Referring now to FIG. 1A, a wedging tool 25 may be attached to the bottom end of liner 12 and lowered along with the liner into the gravel bed. This tool has ribs 25*a* which wedge against the surrounding formation and aid in the fracturing action as described in my U.S. Pat. No. 4,544,031.

Figure 1B:
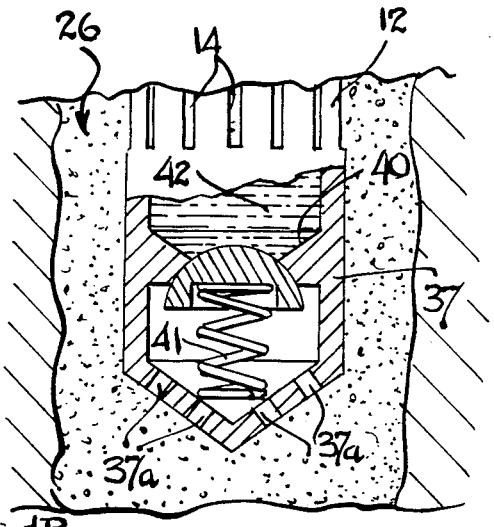
FIG. 1B is a cross sectional view illustrating a further embodiment of the invention for use in softer formations.

Referring now to FIG. 1B, a further embodiment of the invention is illustrated. This embodiment is particularly suitable for use in softer formations where extensive fracturing is not required. In this embodiment the same basic structure of the embodiment of FIG. 1 is employed. Rather than capping off the bottom of the liner 12, however, a shoe 37 is attached to the liner bottom, this shoe having nozzles 37*a* formed therein. Further, a check valve 40 which is urged to its upward closed position by spring 41 is employed.

In operation, a column of a liquid 42 such as water is flowed into liner 12 (or provided by standing liquid in the well). Drill pipe 20 and liner 12 are then sonically driven as in the first embodiment. The sonic energy causes discharge of the liquid from nozzles 37*a* in pulsating jets. The check valve 40 opens and closes in response to the sonic energy in a pulsating manner to further effect sonic pumping action which strengthens the pulsating jets of liquid. The liquid jets operate to hydraulically penetrate and stir the gravel material to increase the fluidity of this material. The use of sonic hydraulic jet action to penetrate earthen material is described, for example in my U.S. Pat. No. 4,548,281.

While the invention has been described and illustrated in detail, it is to be clearly understood that this is intended by way of illustration and example only and is not to be taken by way of limitation, the spirit and scope of the invention being limited only by the terms of the following claims.

I claim:

1. A method for improving the production of effluent from a well formed in an earthen formation and including a casing installed in said well comprising the steps of:

emplacing a granular medium in the bottom of the well, attaching a perforated well liner on the end of a drill pipe, lowering said well liner into the well until it rests on the granular medium, the drill pipe extending up said well to the surface, coupling sonic energy to the drill pipe and the well liner to fluidize the granular medium and cause said medium to uniformly rise and distribute itself tightly around the liner as the liner sinks into the granular medium, so as to provide filtering action for the effluent by causing particles of said granular medium to be driven tightly between the earthen formation and the liner at the bottom of the well.

2. The method of claim 1 wherein the granular medium comprises gravel.

3. The method of claim 1 and further including the step of placing a packing seal around said drill pipe to provide a seal between the casing and the drill pipe to prevent the granular medium from rising up the casing.

4. The method of claim 1 and further including the step of attaching a wedging tool to the bottom end of the well liner, the sonic energy causing the wedging tool to wedge the granular medium against the earthen formation and aid in the fracturing of the formation.

5. The method of claim 1 and additionally including the steps of attaching a shoe member having nozzles formed therein to the bottom end of said liner and forming a column of liquid in said liner, the sonic energy causing pulsating discharge of said liquid from said nozzles into the granular medium thereby increasing the fluidity of said medium.

6. The method of claim 5 and additionally including the step of installing a check valve in said shoe member, said check valve operating in response to the sonic energy to pump the liquid out of said nozzles in pulsating jets.

7. The method of claim 1 wherein the sonic energy is generated by an orbiting mass oscillator.

8. The method of claim 1 including sustaining said sonic energy at a high enough power level so as to cause said granular medium to fracture the earthen formation around said well.

* * * * *